US009314070B2

(12) United States Patent
Koc et al.

(10) Patent No.: US 9,314,070 B2
(45) Date of Patent: Apr. 19, 2016

(54) ADJUSTABLE JEWELRY

(76) Inventors: Yegise Koc, Oradell, NJ (US); Nerses Kafadar, New Milford, NJ (US)

( * ) Notice: Subject to any disclaimer, the term of this patent is extended or adjusted under 35 U.S.C. 154(b) by 0 days.

(21) Appl. No.: 13/068,090

(22) Filed: May 2, 2011

(65) Prior Publication Data

US 2012/0279256 A1 Nov. 8, 2012

(51) Int. Cl.

| | |
|---|---|
| ***A44C 5/06*** | (2006.01) |
| *A44C 17/02* | (2006.01) |
| *A44C 9/02* | (2006.01) |

(52) U.S. Cl.

CPC ... *A44C 5/06* (2013.01); *A44C 9/02* (2013.01); *A44C 17/02* (2013.01); *A44C 17/0241* (2013.01)

(58) Field of Classification Search

CPC ..... A44C 5/04; A44C 5/06; A44C 5/08; A44C 11/00; A44C 17/02

USPC ..... 63/5.1, 38, 41, 3–4; 59/80, 82, 88, 79.1; 24/71 J; 135/145; 403/408.1

See application file for complete search history.

(56) References Cited

U.S. PATENT DOCUMENTS

| | | | | | |
|---|---|---|---|---|---|
| 215,461 | A | * | 5/1879 | Kayser | 63/5.1 |
| 263,920 | A | | 9/1882 | La Grange | |
| 289,511 | A | * | 12/1883 | Danziger | 63/15.45 |
| 794,193 | A | * | 7/1905 | Sommer | 59/79.1 |
| 837,004 | A | * | 11/1906 | Sommer | 59/79.1 |
| 2,401,022 | A | * | 5/1946 | Saccoccio | 63/5.1 |
| 2,444,684 | A | * | 7/1948 | Vastano | 59/79.1 |
| 2,515,817 | A | * | 7/1950 | Augenstein | 59/79.1 |
| 2,564,652 | A | * | 8/1951 | Templeman | 59/79.1 |
| 2,601,094 | A | * | 6/1952 | Corbi | 59/79.1 |
| 2,636,359 | A | * | 4/1953 | Sand | 63/5.1 |
| 2,695,493 | A | * | 11/1954 | Pinson | 59/79.1 |
| 2,713,766 | A | * | 7/1955 | Saccone | 59/79.1 |
| 2,790,302 | A | * | 4/1957 | Minematsu | 59/79.1 |
| 2,825,201 | A | * | 3/1958 | Dansereau | 59/79.1 |
| 2,826,900 | A | * | 3/1958 | Augenstein | 63/5.1 |
| 2,901,895 | A | * | 9/1959 | Augenstein et al. | 63/5.1 |
| 3,135,086 | A | * | 6/1964 | Shibuya | 59/79.1 |
| 3,304,109 | A | * | 2/1967 | Schuster | 403/408.1 |
| 3,396,996 | A | * | 8/1968 | Raptis | 403/408.1 |
| 3,456,972 | A | * | 7/1969 | Drotar | 403/408.1 |
| 3,910,067 | A | | 10/1975 | Rumbaugh | |
| 4,747,724 | A | * | 5/1988 | Nishikawa et al. | 403/388 |
| 4,753,087 | A | | 6/1988 | D'Annunzio | |
| 5,412,956 | A | | 5/1995 | Levy | |
| 5,419,159 | A | | 5/1995 | Muller | |
| 5,605,059 | A | | 2/1997 | Woodward | |
| 6,032,485 | A | | 3/2000 | Steinberg | |
| 6,085,550 | A | | 7/2000 | Ishida | |
| 6,442,970 | B1 | | 9/2002 | Dangelmayer et al. | |
| 7,101,110 | B2 | * | 9/2006 | LaPointe | 403/365 |
| 2004/0052581 | A1 | * | 3/2004 | Assler et al. | 403/408.1 |

OTHER PUBLICATIONS

UK Garden Fencing (Climbing Trellis—Expandable) internet website www.ukgardenfencing.co.uk/acatalog/info_93.html.

* cited by examiner

*Primary Examiner* — Abigail Morrell

(74) *Attorney, Agent, or Firm* — Gallo & Darmanian LLP; Nicholas A. Gallo

(57) ABSTRACT

A piece of jewelry that can be expanded or contracted through the use of linearly interconnected rhombuses where the elements of each rhombus are rotatable with respect to an adjacent rhombus and wherein the various elements are held together by pins of a special design so that the length of the piece of jewelry is easily expanded or contracted at the desire of the wearer but where unintentional expansion or contraction is unlikely.

3 Claims, 7 Drawing Sheets

ADJUSTABLE JEWELRY

BACKGROUND OF THE INVENTION

It is obvious that there would be an advantage in having jewelry—rings, bracelets, necklaces and the like—that are adjustable in length, diameter, etc.

For the jeweler, it would mean that these items can be inventoried as one size fits all.

For the wearer, if the means used for adjustment were simple enough, it would mean that as the size of fingers or wrists change with age or weight, the size of a ring or necklace could be adjusted by the wearer, thus eliminating the need to go back to the jeweler. One could even decide in an instant to wear a ring on a different finger. It is not unknown for it being necessary for a ring to be cut off the wearer. There are some people that cannot realistically wear rings at all due to proportionately large digital bone joints between the middle phalanx and proximal phalanx; those individuals would be able to enjoy the novel experience of wearing such jewelry on their fingers.

It would also mean that as styles change, or particular clothing is worn for a specific occasion, or even on whim, the wearer could change the length of a necklace or earrings. It would actually be exciting if the wearer could easily make the changes while actually wearing the piece—changing one's appearance while looking at one's self in a mirror or even during a short reparation in the middle of an occasion.

The prior art includes many patents on expandable, adjustable jewelry, but the means used to accomplish expandability and adjustability are somewhat primitive, and, most importantly, do not allow an adjustment to be quickly made or even while the piece of jewelry is being worn.

From 1882 (U.S. Pat. No. 0,263,920 to LaGrange) until the present, expandable rings and bracelets have used the rack and pinion principle or derivatives and/or more chic versions thereof. Recently these include—only as examples among many—U.S. Pat. No. 3,910,067 (1975) [Rumbaugh], U.S. Pat. No. 4,753,087 (1988) [D'Annunzio], U.S. Pat. No. 5,412,956 (1995) [Levy], U.S. Pat. No. 5,419,159 (1995) [Muller], U.S. Pat. No. 5,605,059 (1997) [Woodward], U.S. Pat. No. 6,032,485 (2000) [Steinberg], and U.S. Pat. No. 6,085,550 (2000) [Ishida].

U.S. Pat. No. 6,442,970 (2002) [Dangelmayer, et al], uses more sophisticated means to the end, but does not deliver the advantages of the current invention.

BRIEF DESCRIPTION OF THE INVENTION

The jewelry described herein uses a linear series of interconnected and rotatable rhombuses to make adjustability of length or size possible.

DESCRIPTION OF THE DRAWINGS

In this instance, some detailed description of certain aspects of the drawings will make the context of the invention clearer.

Referring to the drawings.

DETAILED DESCRIPTION OF THE INVENTION

The invention employs a linear series of interconnected and rotatable rhombuses to make the piece of jewelry expandable and contractible.

Figure 2:
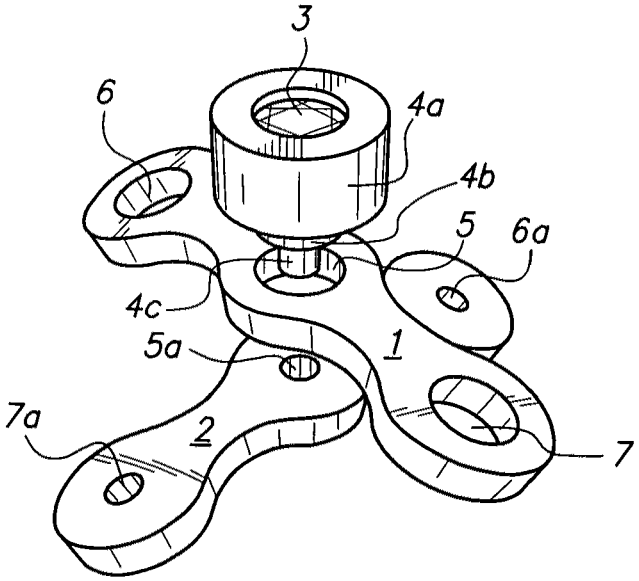
FIG. 2 is an illustration which shows how linear elements 1 and 2 can be connected through holes 5 and 5*a* by circular pin, 3; shows the nature of the circular pin, 3, with three circular portions, 4*a*, 4*b* and 4*c*, of decreasing diameter and shows how the first portion, 4*a*, of the pin will rest on linear element 1, how the second portion, 4*b*, of the pin will rest on linear element 2 and how the third portion, 4*c*, of the pin will pass through hole 5*a* of linear element 2.
Figure 3:
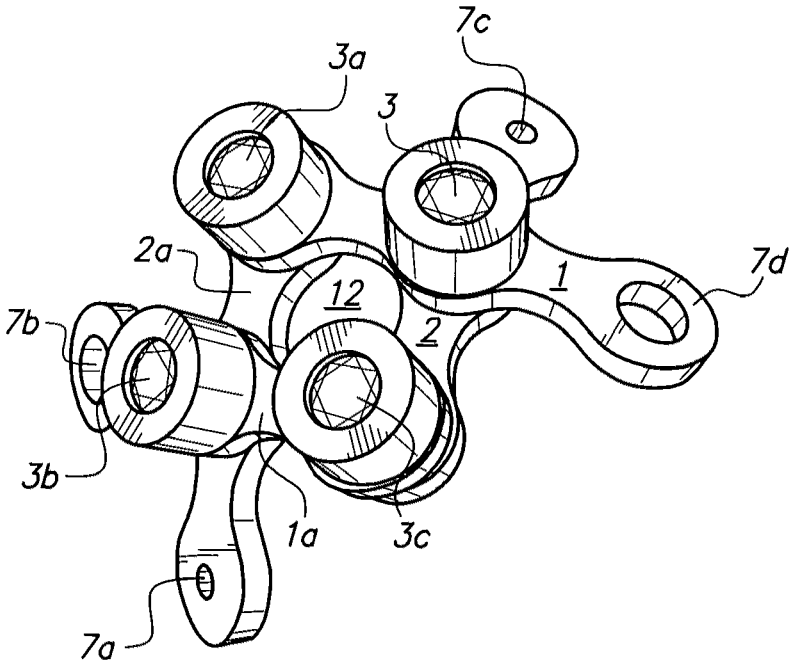
FIG. 3 is an illustration of a single rhombus made up of linear elements 1 and 2 attached to linear elements 1*a* and 2*a*, by pins 3, 3*a*, 3*b*, and 3*c*. Connection of the next linear rhombuses will utilize holes 7*a* & 7*b* at one end, and 7*c* & 7*d* at the other end. It also shows the open space, 12.

Referring once again to FIGS. 1 and 2, the linear elements that make up the four sides of a complete rhombus, as shown in FIG. 3, can be flat or curved, depending on the shape of the eventual piece of jewelry. If it is earrings, the linear elements would normally be flat. If it is a bracelet, the linear elements would likely each be slightly curved.

Figure 1:
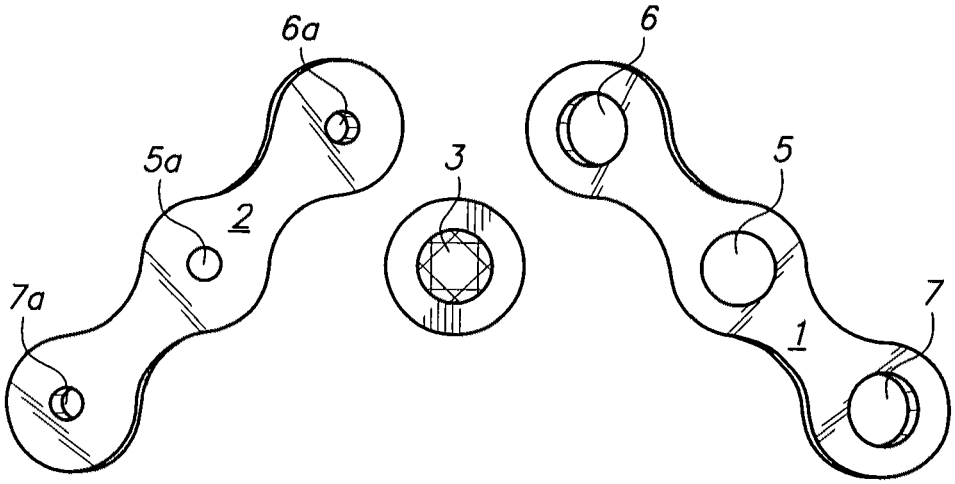
FIG. 1 is a top view showing the design of linear elements 1 and 2, each with round holes, 5, 5*a*, 6, 6*a*, 7 and 7*a*, and a circular connecting pin, 3, which make up the repetitive elements of the rhombuses.

Referencing FIG. 1, the holes, 5&5*a*, 6&6*a* and 7&7*a* in the linear elements should linearly coincide with each other and the end holes, 6&6*a* and 7&7*a*, should be equidistant from the center holes, 5&5*a*, of the linear element.

Continuing to reference FIGS. 1 and 2, the holes, 5, 6 and 7, in the top linear element, 1, should be at least slightly smaller than the top portion, 4*a*, of the pin, 3, so that the first portion, 4*a*, of the pin rests on the top of the top linear element. The holes, 5*b*, 6*b* and 7*b*, of the bottom linear element, 2, should be smaller than both the holes in the top linear element, 1, and the second portion, 4*b*, of the pin, 3, so that the second portion of the pin rests on the top of the bottom linear element. The third portion, 4*c*, of the pin passes through the holes, in the bottom linear element so it can be maintained below the bottom of the bottom linear element by some means. This configuration is essential so that the linear elements are rotatably connected with respect to each other. Although there would be no reason to do so, a degree of the same effect could be achieved by making the top portion, middle portion and bottom portion of the pins of different shape than the holes in the linear elements It is important that the wearer be able to easily change the length of the piece of jewelry, but that the length of jewelry not change when the wearer does not want it to do so. Referring to FIG. 2, it is strongly preferred that the circumference of the second portion, 4*b*, of pin 3, be almost as large as hole 5 and that the circumference of the third portion, 4*c*, of pin 3, be almost as large as hole 5*a*. Thus the elements will have a friction fit.

The holes can be any shape as long as the third portion of a pin will pass through the hole in the bottom linear element. While there would be no reason to do so, the holes in the bottom linear element could be of various shapes in any one piece of jewelry as long as the bottom section of any given pin would pass through the corresponding hole. By analogy the same would be true of the top linear element, as long as the second portion of the pin passes through the corresponding hole in the top linear element.

Figure 5:
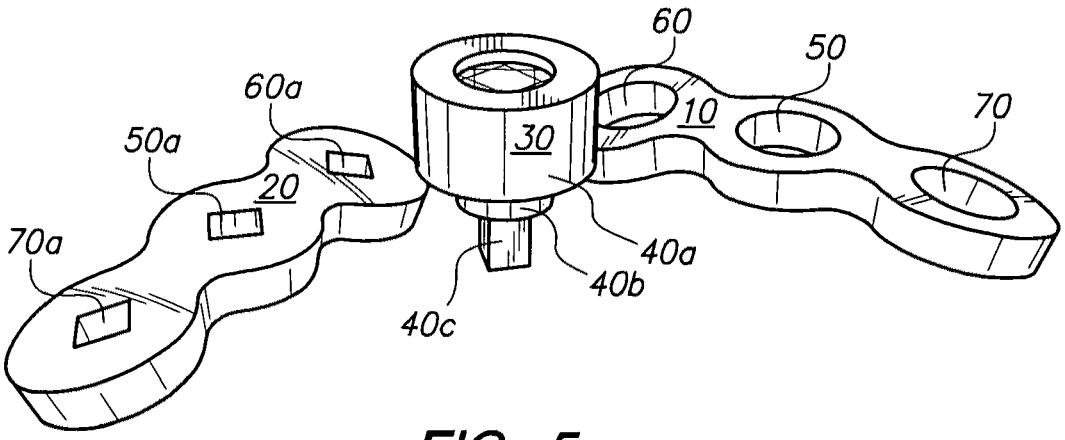
FIG. 5 is an illustration comparable to FIG. 1 of the elements of an alternate embodiment of the invention wherein linear element 10 has circular holes, 50, 60 and 70, where linear element 20 has square holes, 50*a*, 60*a* and 70*a*, and the third portion, 40*c*, of pin 30 is square.
Figure 6:
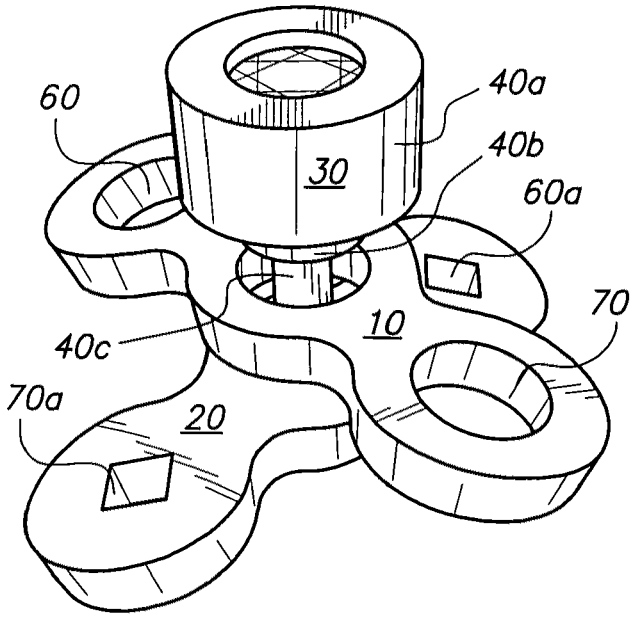
FIG. 6 is an illustration comparable to FIG. 2 illustrating how the elements of the embodiment of the invention shown in FIG. 5 fit together.

In practice it has been found that a square third portion, 40*c* of the pin, 30, as shown in FIGS. 5 and 6, is preferred so that the fixed connection of it to the bottom linear element is stronger than a mere weld or the like.

Figure 4B:
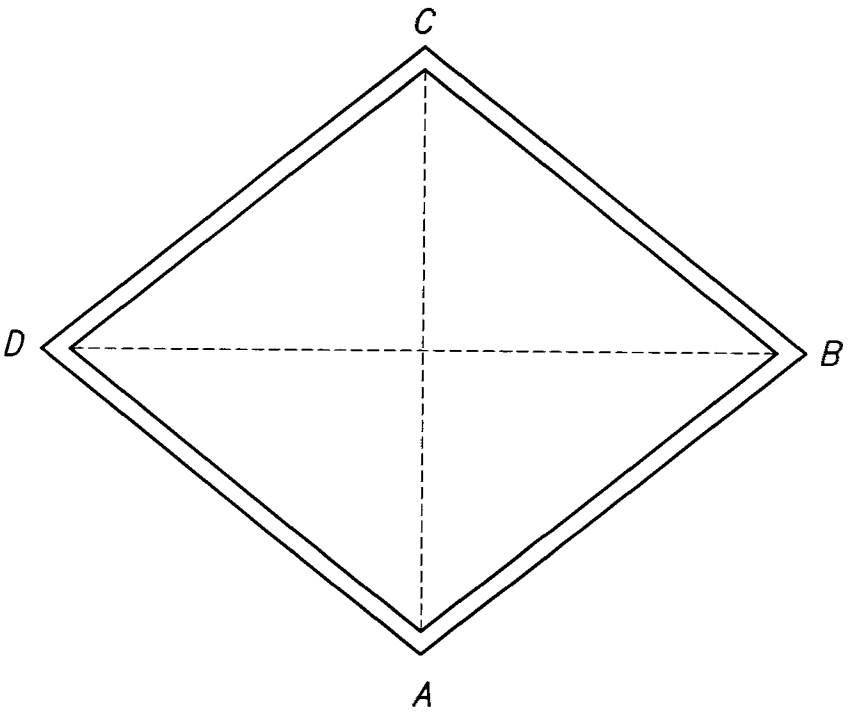
FIGS. 4A and 4B are representations showing generally how the shape and angles of a rhombus—a parallelogram with four sides of equal length—are altered when compressed or extended so that the distance between opposing corners A&C and B&D are also compressed or extended.
Figure 4A:
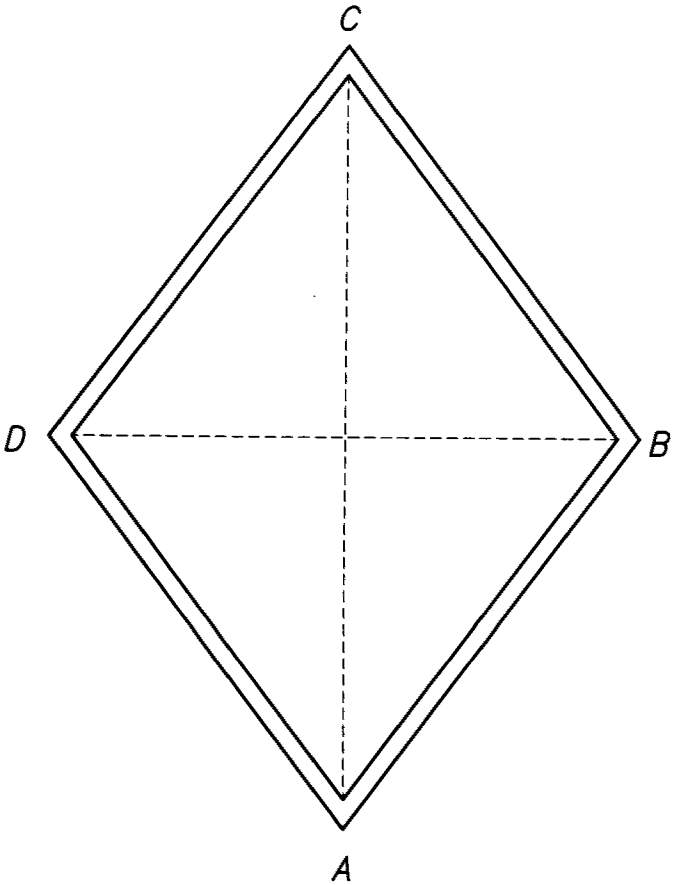

A rhombus is a quadrilateral, or parallelogram, with equal sides. The total of the internal angles is fixed at 360°. The opposite angles of a rhombus are the same and opposing sides of a rhombus are parallel to each other. FIGS. 4 illustrate two configurations of a rhombus in which the distance between opposing corners is changed. In the representation shown, the distance between corners A and C as shown in FIG. 4A is greater than that shown in FIG. 4B, while the distance between corners B and D as shown in FIG. 4A is less than that shown in FIG. 4B. The internal angles at corners A and C as shown in FIG. 4A are less than those shown in FIG. 4B while the internal angles at corners B and D as shown in FIG. 4A are greater than those shown in FIG. 4B. The length of the sides is the same and the total of the angles is unchanged. These relationships are important to the invention. As shown in the representation, each side has a thickness. In practice, the corners would be rotatable.

As noted earlier, FIG. 3 shows one complete rhombus formed as described. A first top linear element, 1, is rotatably attached to a first bottom linear element, 2, through their respective central holes, 5 and 5*a*. A second top linear element, 1*a*, is rotatably attached to a second bottom linear element, 2*a*, through their respective central holes, not shown. The first top linear element, 1, is rotatably attached to the second bottom linear element, 2*a*, through one of their respective end holes, not shown, and the second top linear element is rotatably attached to the first bottom linear element through one of their respective end holes, not shown, whereby a rhombus with space 12 is formed. By pulling or pushing on the ends, 7 or 7*a*, and on ends 8 or 8*a*, the distance between those ends will expand or contract and the shape of the rhombus will change. This is how the length or circumference of the piece of jewelry is changed.

When it is stated that the expansion or contraction is made by application of linear force, this includes such force when applied circumferentially Referring again to FIG. 3, the plurality of rhombuses are connected through holes comparable to 7 and 7*a* at one end and holes 8 and 8*a* at the other end. This is more clearly shown in FIGS. 8 and 9.

Figure 7:
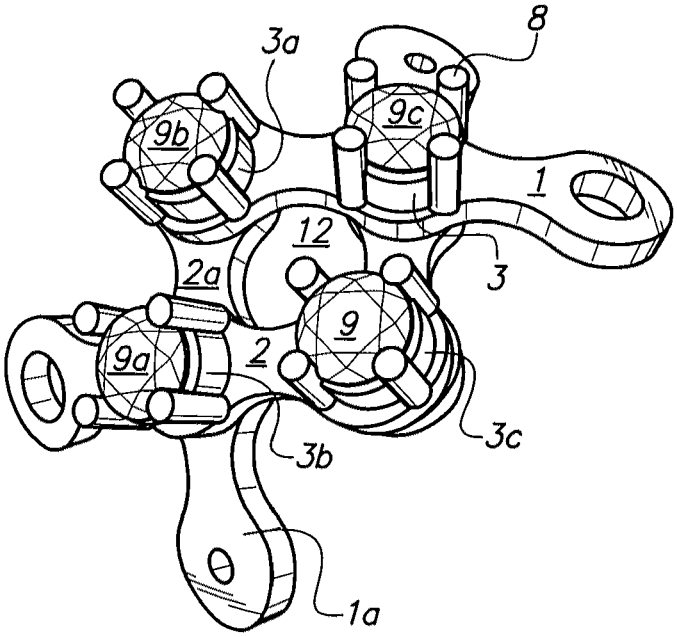
FIG. 7 is an illustration of the rhombus of FIG. 3 in which the pins have attached thereto protuberances, 8, that can hold jewels, 9, 9*a*, 9*b* and 9*c*

The underlying object being a piece of jewelry, stones or other decoration will usually be needed. The means of doing this is shown in FIG. 7. Each pin has around its periphery protuberances, 8, that would hold stones, 9, in place.

Figure 8:
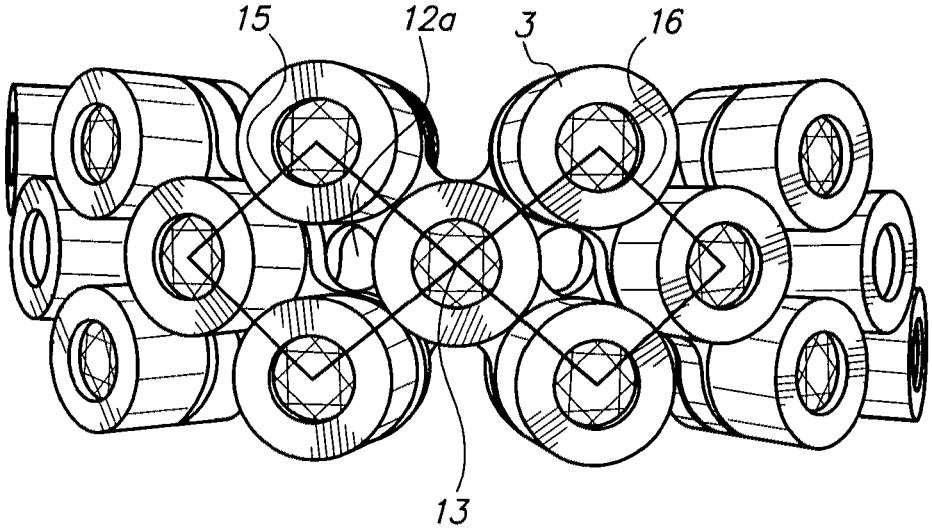
FIG. 8 is a top view illustrating several rhombuses, 15 and 16, interconnected in a linear formation at point 13 that would, when the terminal ends are attached to each other in some way, make up a necklace, bracelet, ring or the like. The piece of jewelry shown is in an expanded position and defines space, 12*a*.
Figure 9:
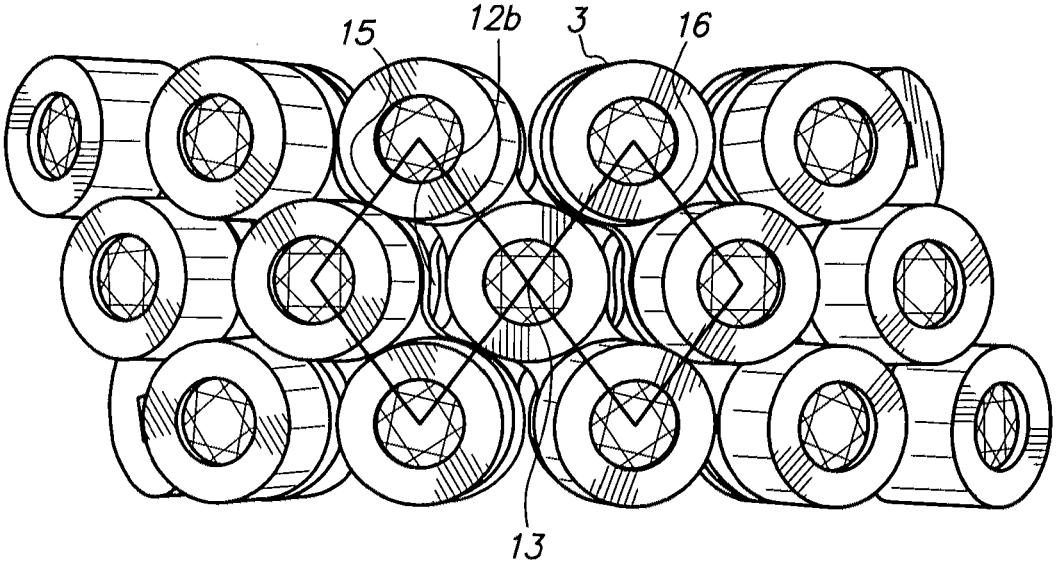
FIG. 9 is a top view illustrating the interconnected rhombuses of FIG. 8 in which the total length has been decreased by applying a compressive linear force to the ends thereof. In this form substantially reduced space, 12*b*, is defined.
Figure 10:
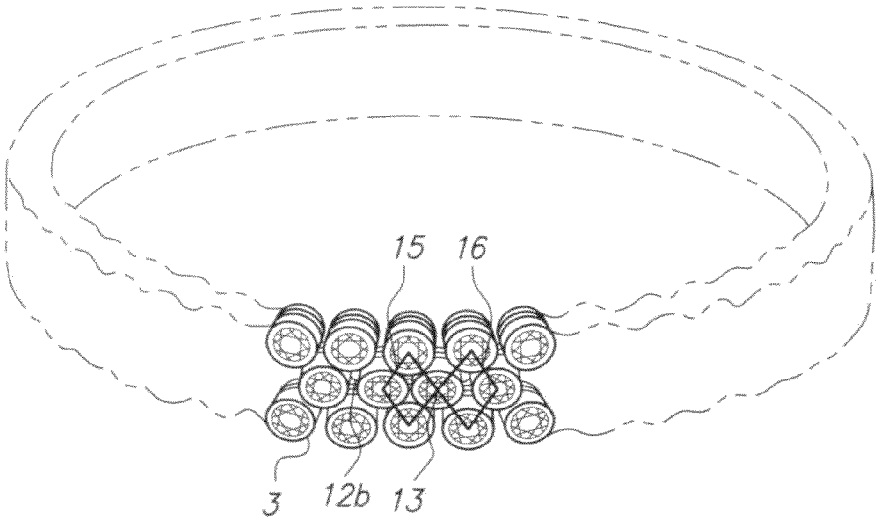
FIG. 10 is a representation of a bracelet made of such rhombuses shown in compressed condition, equivalent to that shown in FIG. 9.
Figure 11:
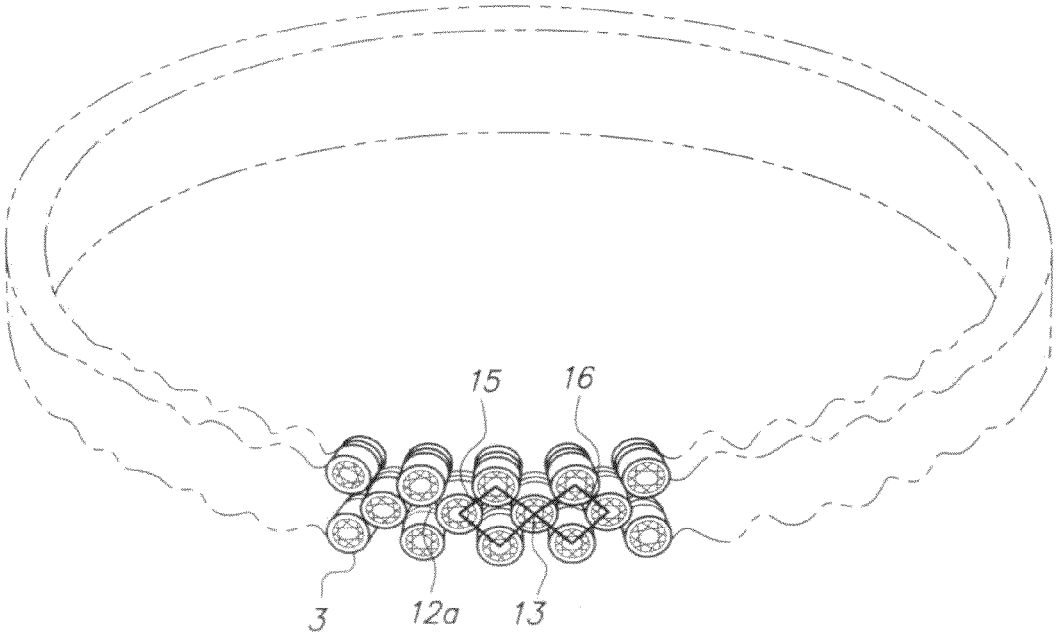
FIG. 11 is representation of the bracelet of FIG. 10 in an expanded condition, equivalent to that shown in FIG. 8.

To form a piece of jewelry a plurality of interconnected rhombuses is required and if the piece of jewelry is circular, such as a ring or bracelet, the ends must be connected. This is shown in FIGS. 8 and 9 as well as FIGS. 10 and 11. These figures also show more clearly how the adjacent rhombuses are connected.

In the piece of jewelry shown in FIGS. 8 and 9, rhombus 15 and rhombus 16 are joined and point 13 is the common connection. The rhombuses define a space 12 and 12*a*. In FIG. 8, the space, 12*a*, defined is consistent with the rhombuses in an extended position. In FIG. 9, the space, 12*b*, defined is consistent with the rhombuses in a compressed position. These positions define the length of the piece of jewelry.

The embodiments of the invention have been shown at a particular width. If a greater width is desired, longer linear elements with an increased number of holes and points of attachments-are required.

The piece of jewelry can be made of any sturdy material, such as silver, that will withstand the forces applied to expand or contract the same.

What is claimed is:

1. A piece of jewelry comprising:

a series of linearly connected rhombuses;

each rhombus being defined by a first pair of elements and a second pair of elements;

the first pair of elements including a first top element rotatably connected to a first bottom element via a first pin, the first pin defining a first corner of the respective rhombus;

the second pair of elements including a second top element rotatably connected to a second bottom element via a second pin, the second pin defining a second corner of the respective rhombus;

the first top element being rotatably connected to the second bottom element via a third pin, the third pin defining a third corner of the respective rhombus;

the second top element being rotatably connected to the first bottom element via a fourth pin, the fourth pin defining a fourth corner of the respective rhombus;

the first pin passing through a central hole in each of the first top and bottom elements, the central hole of the first top element being larger than the central hole of the first bottom element;

the second pin passing through a central hole in each of the second top and bottom elements, the central hole of the second top element being larger than the central hole of the second bottom element;

the third pin passing through an end hole of the first top element and an end hole of the second bottom element, the end hole of the first top element being larger than the end hole of the second bottom element;

the fourth pin passing through an end hole of the second top element and an end hole of the first bottom element, the end hole of the second top element being larger than the end hole of the first bottom element;

each pin having a top section, a middle section, and a bottom section;

the top section being larger than the middle and bottom sections and being larger than the holes of the first and second top elements, the bottom of the top section residing on a top surface of one of the first and second top elements;

the middle section being larger than the bottom section and being larger than the holes of the first and second bottom elements, the middle section frictionally engaging one of the holes of the first and second top elements, the bottom of the middle section residing on a top surface of one of the first and second bottom elements;

the bottom section being smaller than the holes of the first and second top elements, the bottom section frictionally engaging one of the holes of the first and second bottom elements; and whereby the shape of each rhombus can be changed by application of linear force to alter the linear dimensions of the series of rhombuses and to thus alter one of the length and circumference of the piece of jewelry.

2. The piece of jewelry according to claim 1, wherein each element is generally elongated in shape.

3. The piece of jewelry according to claim 2, wherein the holes of each bottom element and the bottom section of each pin are square in shape.

* * * * *